US007219542B2

(12) United States Patent
Fäh et al.

(10) Patent No.: US 7,219,542 B2
(45) Date of Patent: May 22, 2007

(54) STANDARDIZED TESTING OF THE QUALITY OF WASHING, CLEANING AND DRYING PROCESSES IN AGGREGATES

(75) Inventors: Daniel Fäh, Teufen (CH); Felix Frey, Horn (CH)

(73) Assignee: EMPA Testmaterialien AG, St. Gallen (CH)

( * ) Notice: Subject to any disclaimer, the term of this patent is extended or adjusted under 35 U.S.C. 154(b) by 55 days.

(21) Appl. No.: 10/524,944

(22) PCT Filed: Mar. 19, 2004

(86) PCT No.: PCT/IB2004/000825

§ 371 (c)(1),
(2), (4) Date: Feb. 18, 2005

(87) PCT Pub. No.: WO2004/085725

PCT Pub. Date: Oct. 7, 2004

(65) Prior Publication Data

US 2005/0241383 A1 Nov. 3, 2005

(30) Foreign Application Priority Data

Mar. 25, 2003 (EP) ..... 03006617

(51) Int. Cl.
*G01L 5/04* (2006.01)

(52) U.S. Cl. ..... 73/159

(58) Field of Classification Search ..... 73/159, 73/818, 826

See application file for complete search history.

(56) References Cited

U.S. PATENT DOCUMENTS 3,975,956 A * 8/1976 Peel ..... 73/159
4,894,919 A * 1/1990 Ziegert ..... 33/17 R
5,025,837 A * 6/1991 Gielen ..... 139/35
6,439,036 B1 8/2002 Mansky

OTHER PUBLICATIONS

"Surface active agents—Evaluation of certain effects of laundering—Methods of preparation of use of unsoiled cotton control cloth" ISO 2267-1986 (E) Apr. 15, 1986, XP 008020088 paragraphs '03.5! '5.1.1!, '5.1.2!, Enclosed!
Intntl Srch Rep.

* cited by examiner

*Primary Examiner*—Max Noori
(74) *Attorney, Agent, or Firm*—Collard & Roe, P.C.

(57) ABSTRACT

A test medium and the use of a corresponding test material are provided for detecting the mechanical load in different assemblies, such as, for example, washing, cleaning and drying machines. A substrate is used, which under mechanical stress loses part of its volume, its weight, or its area, the loss then related to the treatment or processing in the assemblies. The test medium is preferably formed by a fabric composite.

2 Claims, 1 Drawing Sheet

Figure 1:
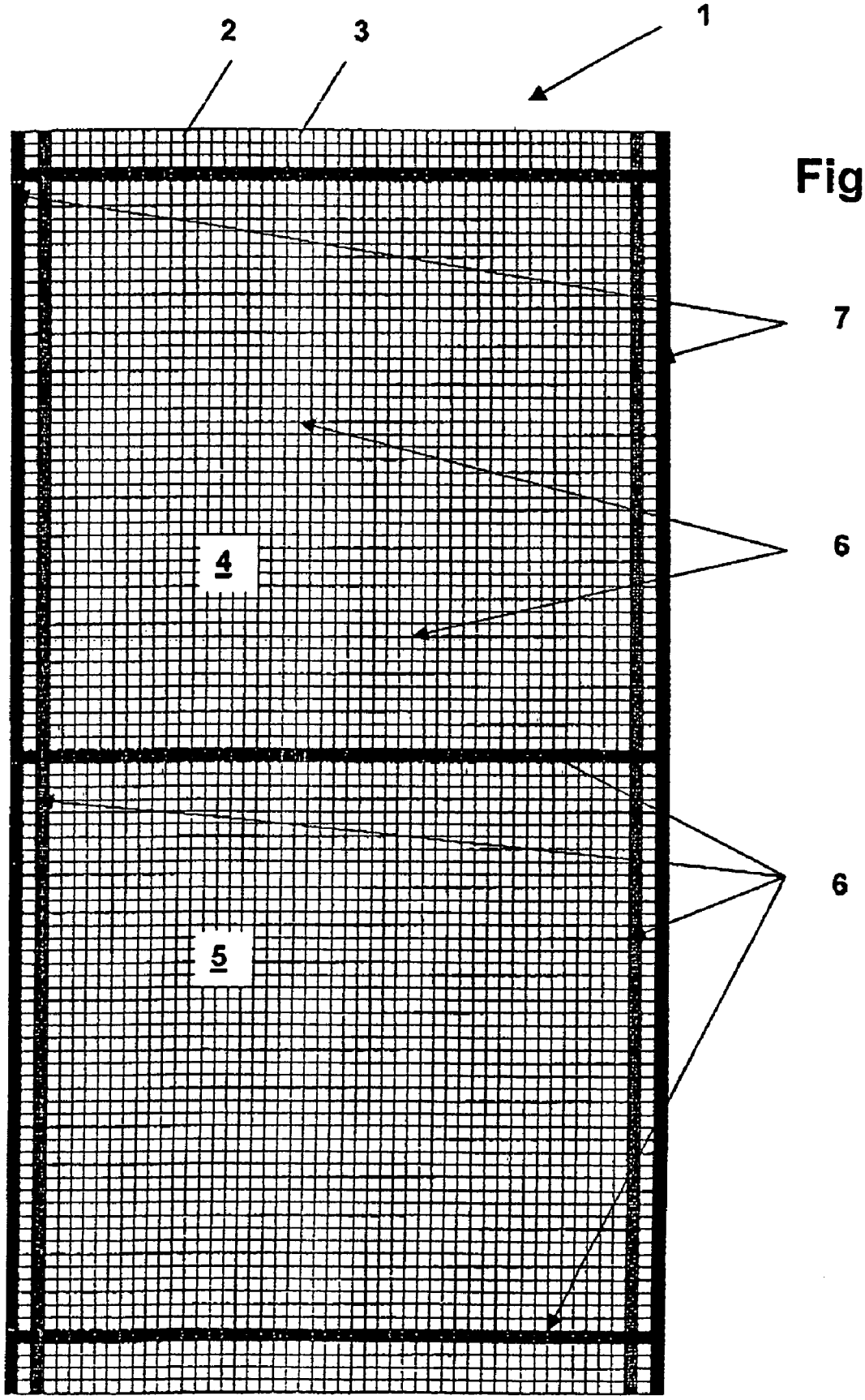

STANDARDIZED TESTING OF THE QUALITY OF WASHING, CLEANING AND DRYING PROCESSES IN AGGREGATES

CROSS REFERENCE TO RELATED APPLICATIONS

Applicants claim priority under 35 U.S.C. §119 of European Application No. EP03006617.9 filed on Mar. 25, 2003. Applicants also claim priority under 35 U.S.C. §365 of PCT/IB2004/000825filed on Mar. 19, 2004. The international application under PCT article 21(2) was not published in English.

The invention relates to a method for the testing of assemblies in which processes for the washing, cleaning and drying of sheetlike textile structures are conducted. The invention relates, furthermore, to a test means for carrying out the testing of assemblies in which the washing, cleaning and drying processes are conducted.

DEFINITIONS

The term "sheetlike textile structures" is to be understood as meaning, in particular, woven and knitted fabrics, hosiery articles, nonwovens and felts.

What is to be understood by assemblies in which washing, cleaning and drying processes are to be conducted are those appliances in which, in particular, sheetlike textile structures are processed. The processing may involve washing the sheetlike textile structure (washing machines or cleaning machines) or drying it after a washing process (driers).

PRIOR ART

These assemblies consist, as a rule, of a rotating drum, into which the sheetlike textile structure to be processed, in the form of clothing or the like, is introduced. In addition, further additives, such as stones, washing agents, softeners or other aids or additives, may be added. By the drum being rotated, the sheetlike textile fabric is tumbled, so that the latter is subjected to mechanical stress together with water and additives. As a result, the sheetlike textile structure is loaded, specifically such that individual fibers and/or fibrous composites are subjected to high mechanical stress, and tearing, tears or other fiber breaks thus occur.

In order to test the quality of such assemblies with regard to the mechanical load which they exert on the sheetlike textile structure, there is, for example, according to the prior art, provision for producing what are known as test means whereby it can be established how high the mechanical stress on textile fabric is during washing, cleaning and drying processes in different assemblies.

For this purpose, it is proposed to use test materials in the form of a fibrous fabric which has predetermined punched-out holes in the fabric which then, owing to the mechanical stress during the washing, cleaning and drying operation, are correspondingly enlarged in that the individual fiber strands or textile fibers come loose. However, the fiber strands do not come loose from the entire fibrous composite, but are firmly enclosed at their ends in the fibrous composite and come loose from the latter only in the region of the hole.

The number of fibrous strands which have come loose in the region of the hole is then an indication of the mechanical load on the textile fabric during the washing, cleaning and drying operation. The more textile fibers or threads which have come loose, the higher is the mechanical load.

The mechanical force which acts on the sheetlike textile structure during the washing, cleaning and drying process is therefore critical for the mechanical processing of the sheetlike textile structure. This force, in turn, is an indication of the quality of the corresponding assembly, in particular of the washing, cleaning and drying machines. Repeated flexing, stretching and tumbling or milling movements, which are all intended to wash the dirt out of the sheetlike textile structures, have an adverse effect on the quality of the sheet like textile structure.

A further alternative test method is, in particular by means of long-time measurements, to test the tearing strength of the mechanically processed fabric which has been washed in a washing drum.

The abovementioned methods are highly complicated and costly and may be affected greatly, particularly in tearing strength, by chemical influences, such as bleaching agents. Furthermore, comparison with other types of investigation is very difficult, since the initial textile product and other parameters are not standardized.

OBJECT OF THE INVENTION

The object of the invention is to provide a test means and a method and a use of a test means, by means of which the mechanical activity of the assembly and the associated mechanical load exerted on sheetlike textile structures, such as, for example, woven and knitted fabrics, nonwovens, etc., during a washing, cleaning and drying process by means of different drums can be determined in a standardized manner. The aim is therefore to be that the mechanical load exerted on the sheetlike textile structure by the assembly and the comparison of different assemblies with one another can be implemented as accurately as possible by such a test means and by means of the method and also the use of the test means.

A field assessment is thus to be ensured.

SOLUTION FOR ACHIEVING THE OBJECTS

The essential idea of the invention is to propose a substrate or a test means which, under mechanical stress, loses part of its volume, of its weight and/or of its area, the test means having been exposed to a treatment of, for example, a washing, cleaning and drying process.

As a result of the mechanism which occurs during the treatment of the substrate, in particular tumbling, flexing, stretching or the like, more or fewer fractions of the volume, weight or area are loosened from the test means, depending on the loading intensity. The number of size of the volume, of the weight or of the corresponding area which has come loose stands as a measure of the mechanical load which has occurred.

The substantial advantage of the invention is that a standardized method for testing the mechanical and/or chemical load exerted by different assemblies during washing, cleaning and drying purposes can be carried out. It is consequently possible, by the processing of the respective standardized test means, to discover how high the mechanical load exerted by the corresponding assembly to be tested is in comparison with the remaining assemblies.

As a highly preferred example, a fabric is proposed which consists, for example, of a linen weave and has specified dimensions. The test means proposed here has, in addition, colored subdivision threads which make it possible in a simple way to count up the loosening of the corresponding threads which is caused by the mechanical loading.

In principle, however, all natural and synthetic fibers are also their mixture are possible. The fiber fineness, the yarn linear density, the number of threads per cm, the weave and the design of the fabric may be standardized and appropriately adapted to the intended use.

As a further application example, three-dimensional test means may also be provided, which consist of different individual elements and are connected to one another. Here, too, the loosening of the individual elements is a measure of the mechanical loading caused by processing in the corresponding assemblies.

Further advantageous embodiments may be gathered from the following description and from the drawing.

DRAWING

FIG. 1 shows a diagrammatic top view of the construction of a test means, here, in particular, of a fabric with a corresponding construction.

DESCRIPTION OF AN EXEMPLARY EMBODIMENT

FIG. 1 illustrates a test means 1 in the form of a fabric. This fabric consists of threads 2 and threads 3, the threads 2, 3 being arranged preferably perpendicularly to one another.

The test means 1 proposed here has, for example, two sections 4 and 5, each section consisting preferably of 500 threads (horizontal threads 3).

The respective sections 4, 5 have boundary threads 6 which are identified by color and by means of which it is to become easier to count up the loosened threads 2, 3 correspondingly.

In addition, the selvedge 7 is likewise identified by color. The idea according to the invention is, then, to use such a test means 1, which is illustrated as in FIG. 1 and is preferred, as a test means for establishing the mechanical processing carried out by assemblies In the case of the test means 1 proposed here, the assessment of the patterns after mechanical processing takes place by reference to the loosened threads after the respective processing/treatment in the corresponding assembly.

In this case, different assessment criteria may be adopted, and in this case it is proposed to use the following subdivision:

Threads removed completely: these are all the threads which are no longer anchored in the fabric composite.

Threads removed by more than 50%: these are all the threads which are loosened from the fabric composite by more than 50%.

Threads removed by more than 30%: these are all the threads which are loosened from the fabric composite by more than 30%.

All threads removed: the total of the removed threads according to the above listing.

The assessment may also take place automatically, in that the processed fabric is laid under a detection device, and the correspondingly loosened threads are then detected. In this case, the boundary threads 6 and the selvedge 7 which are identified by color provide assistance. In addition, threads which are provided in color in the weft direction and which likewise make assessment possible may also be provided.

Alternatively to the colored implementation, threads may be provided which differ from the remaining threads in terms of size and/or their nature.

In principle, however, all natural and synthetic fibers and also their mixture are possible. Protection is not to be restricted to the test means proposed here as an exemplary embodiment. On the contrary, those test means are to be covered in which a reaction to the mechanical loading caused by processing in the corresponding assemblies, such as washing, cleaning and drying machines, can be triggered.

The invention claimed is:

1. A method for standardized testing of assemblies in which washing, cleaning and drying processes are conducted, by treatment and effect of the treatment on textile fabric, comprising the following steps:

a. introducing into the assembly a test article comprising a two- or three-dimensional article formed by individual elements or sections which are connected to one another and are at least partially displaced or come loose due when acted upon by mechanical loads which occur as a result of the washing, cleaning and drying processes;

b. processing the test article in the assembly; and c. counting the sections or elements which have completely or partially come loose from the test article.

2. A test article for standardized ascertainment of stress exerted on textile fabrics in assemblies carrying out washing, cleaning, or drying processes comprising a fabric having a plurality of interconnected threads and a plurality of boundary threads differing in at least one of color, size, or constitution from the interconnected threads, said interconnected threads being at least partially displaced or detached when subjected to mechanical stress during the washing, cleaning, or drying processes, said boundary threads forming a plurality of subdivisions in said fabric from which said interconnected threads extend to facilitate counting of the interconnected threads partially displaced or detached as a result of the stress exerted during the washing, cleaning, or drying processes.

* * * * *